United States Patent [19]

Hrivnak et al.

[11] Patent Number: 5,049,339

[45] Date of Patent: Sep. 17, 1991

[54] PROCESS FOR MANUFACTURING INDUSTRIAL YARN

[75] Inventors: John E. Hrivnak, Clinton; Donald L. Brown, Hudson, both of Ohio; Richard M. Oblath, Huntsville, Ala.

[73] Assignee: The Goodyear Tire & Rubber Company, Akron, Ohio

[21] Appl. No.: 374,806

[22] Filed: Jul. 3, 1989

[51] Int. Cl.[5] ..... D01D 5/12

[52] U.S. Cl. ..... 264/210.8; 264/211.17; 264/290.5

[58] Field of Search ..... 264/210.8, 210.5, 290.5, 264/211.15, 211.17

[56] References Cited

U.S. PATENT DOCUMENTS

| | | | |
|---|---|---|---|
| 3,361,859 | 1/1968 | Cenzato | 264/176 |
| 3,452,132 | 6/1969 | Pitzl | 264/210.8 |
| 4,113,821 | 9/1978 | Russell et al. | 264/210.8 |
| 4,491,657 | 1/1985 | Saito et al. | 528/308.1 |
| 4,669,159 | 6/1987 | Bogucki-Land | 28/185 |
| 4,755,336 | 7/1988 | Deeg et al. | 264/103 |

FOREIGN PATENT DOCUMENTS

| | | | |
|---|---|---|---|
| 034880 | 1/1981 | European Pat. Off. | 264/210.8 |
| 315128 | 12/1986 | Japan . | |

*Primary Examiner*—Jan H. Silbaugh
*Assistant Examiner*—Brian Jones
*Attorney, Agent, or Firm*—Alvin T. Rockhill

[57] ABSTRACT

Industrial yarn is used as a reinforcement in a wide variety of manufactured articles, such as conveyor belts, drive belts, V-belts, seat belts, hoses, tires, and the like. It is often important for the industrial yarn to have high tenacity, high modulus and dimensional stability. The present invention discloses an improved process for manufacturing highly uniform industrial yarn which exhibits high tenacity, high modulus and very low shrinkage. The present invention more specifically discloses a process for manufacturing industrial yarn having high tenacity, high modulus and low shrinkage which comprises melt spinning polyethylene terephthalate into spun filaments and subsequently drawing the spun filaments in a heated zone to a draw ratio of at least about 1.05:1; wherein the spun filaments have a birefringence of at least about 0.075 and a crystallinity of at least about 10%; wherein the spun filaments are in the heated zone for a residence time of at least 0.3 seconds; and wherein the yarn in the heated zone is at a temperature which is between the glass transition temperature and the melting temperature of the polyethylene terephthalate.

14 Claims, No Drawings

PROCESS FOR MANUFACTURING INDUSTRIAL YARN

BACKGROUND OF THE INVENTION

Polyethylene terephthalate (PET) resin is widely utilized in manufacturing industrial yarn. Industrial yarn made utilizing PET usually has much higher modulus and tenacity than textile yarn made utilizing PET. Industrial yarn usually also has a much higher denier than textile yarn. For example, industrial PET yarns commonly possess a tenacity of at least 6.2 cN/dtex (centinewtons/decitex) and have a dtex of about 833 to about 2220, while textile polyester yarns commonly have a tenacity of only about 3.0 to 4.0 cN/dtex and have a decitex of about 111 to about 556. It is important for industrial yarns to have higher levels of modulus and tenacity to be useful as reinforcements for manufactured articles, such as tires, hoses, belts, and the like. Such industrial yarns are of particular value as reinforcements for tires, conveyor belts, and power transmission belts.

In many applications it is also important for industrial yarns to exhibit dimensional stability as well as high modulus and high tenacity. It has been widely recognized that higher melt spinning speeds usually result in the production of yarns which exhibit lower shrinkage. Unfortunately, the utilization of increased melt spinning speeds results in yarns which have reduced tenacity. Increased melt spinning speeds have accordingly not proven to be an acceptable means for commercially producing industrial yarns which exhibit low levels of shrinkage in combination with high tenacity. In fact, heretofore, melt spun filaments have been formed through the utilization of relatively low stress spinning conditions to yield spun filaments having relatively low birefringence of less than about 0.03. Such melt spun filaments are particularly amenable to subsequent hot drawing procedures whereby the required tenacity values are ultimately developed. Such as-spun filaments are commonly subjected to subsequent hot drawing which may or may not be conducted in-line when forming textile as well as industrial fibers to develop the desired tensile properties. Drawing procedures which are carried out subsequent to the melt spinning process can have a significant effect on drawn yarn shrinkage. However, drawing procedures alone cannot typically be used to significantly improve yarn dimensional stability.

SUMMARY OF THE INVENTION

The subject invention relates to a process for manufacturing high strength industrial yarn which exhibits low shrinkage. High strength industrial cord produced from the yarn of this invention preferably has a shrinkage as measured after 2 minutes at 350° F. (177° C.) of less than about 2% and more preferably has a shrinkage of less than about 1.5%. In the process of this invention, spun filaments having a birefringence of at least about 0.075 and a crystallinity of at least about 10% are prepared. This is normally done by melt spinning at a spinning speed which is in excess of 2,500 meters per minute. The spun filaments made are subsequently drawn in a heated zone to a draw ratio of at least about 1.05:1. It is important for the spun filaments to be in the heated zone for a residence time of at least 0.3 seconds. This is typically accomplished by utilizing a relatively slow speed multiple-end drawing procedure. Thus, the process of this invention is typically carried out utilizing a high spinning speed in conjunction with a lower drawing speed.

The subject invention more specifically discloses a process for manufacturing industrial yarn having high tenacity, high modulus and dimensional stability which comprises melt spinning polyethylene terephthalate into spun filaments and subsequently drawing the spun filaments in a heated zone to a draw ratio of at least 1.05:1: wherein the spun filaments have a birefringence of at least about 0.075 and a crystallinity of at least about 10%; wherein the spun filaments are in the heated zone for a residence time of at least 0.3 seconds: and wherein the yarn in the heated zone is at a temperature which is between the glass transition temperature and the melting temperature of the polyethylene terephthalate.

The subject invention also discloses a process for manufacturing industrial yarn having high tenacity, high modulus and low shrinkage which comprises drawing polyethylene terephthalate spun filaments in a heated zone to a draw ratio of at least 1.05:1: wherein the spun filaments have a birefringence of at least about 0.075 and a crystallinity of at least about 10%; wherein the spun filaments are in the heated zone for a residence time of at least 0.3 seconds; and wherein the yarn in the heated zone is at temperature which is between the glass transition temperature and the melting temperature of the polyethylene terephthalate.

DETAILED DESCRIPTION OF THE INVENTION

The spun filaments utilized in accordance with this invention are made by melt spinning PET. The PET used will typically have an intrinsic viscosity of at least about 0.8 dl/g. It is normally preferred for the PET to have an intrinsic viscosity of at least about 0.9 dl/g. It is most preferred for the PET to have an intrinsic viscosity of at least about 1.0 dl/g. The intrinsic viscosities referred to herein are measured in a 60/40 phenol/tetrachloroethane mixed solvent system at 30° C. The PET can be made by utilizing a batch process or a continuous process. For example, the PET can be made by the process disclosed in U.S. Pat. No. 4,755,587.

It is to be understood that the PET used in making the spun filaments utilized in accordance with this invention can contain minor amounts of repeat units derived from monomers other than terephthalic acid or a diester thereof and ethylene glycol. For example, small amounts of isophthalic acid can be polymerized into the PET used in making the spun filaments. Minor amounts of other aromatic and/or aliphatic polybasic dicarboxylic acids, known to those skilled in the art, can also be polymerized into the PET. Minor amounts of glycols other than ethylene glycol and polyhydric alcohols can also be polymerized into the PET. In some cases, it is highly desirable to utilize internal lubricant modified PET for improved processability. Thus, the PET utilized in making the spun filaments of this invention contains predominantly repeat units which are derived from terephthalic acid or a diester thereof and ethylene glycol, but can also contain small amounts of repeat units derived from other polybasic carboxylic acids, glycols, and polyhydric alcohols. Persons skilled in the art generally know how much of these other monomers can be incorporated into the PET without greatly affecting its properties and, thus, its usefulness in making the spun filaments of this invention. As a rule, this minor amount will not exceed about 5%. However, in most cases this minor amount will be less than about 3%. In the case of polyhydric alcohols, not more than about 1% will be incorporated into the PET. It will generally be preferred for the PET to be a homopolymer of terephthalic acid or a diester thereof and ethylene glycol.

The spun filaments are made by extruding molten PET through one or more spinnerettes having a plurality of openings. The number of openings in the spinnerette can be varied widely. For example, a standard spinnerette containing from 1 to about 600 holes can be utilized. In most cases, it will be desirable for the spinnerette to contain from about 95 to about 380 holes. Typically the yarns will contain from 190 to 380 filaments which can be produced utilizing split threadlines. The holes in the spinnerette typically have a diameter which is within the range of about 5 mils (0.01 centimeter) to about 50 mils (0.13 centimeter). It is generally preferred for the holes in the spinnerette to have a diameter which is within the range of about 10 mils (0.03 centimeter) to about 30 mils (0.08 centimeter).

The PET is, of course, supplied to the spinnerette at a temperature above its melting point and below the temperature at which it thermally degrades substantially. The molten PET being melt spun is preferably at a temperature within the range of about 275° C. to about 325° C. It is most preferable for the PET being melt spun to be at a temperature of about 280° C. to about 310° C. when it is extruded through the spinnerette.

Following extrusion through the spinnerette, the molten PET filaments are passed through a solidification zone wherein the molten PET filaments are uniformly quenched to transform them to solid spun filaments. The quench employed is uniform in the sense that differential or asymmetrical cooling is not contemplated. However, it is desirable to control the quenching of PET after it exits the spinnerette. This is because it is necessary to provide the spun filaments with sufficient spinning orientation to provide a minimum birefringence of at least about 0.075 and a crystallinity of at least about.10%. To attain the requisite birefringence and crystallinity, a high speed spinning procedure will normally be employed. As a general rule, a minimum spinning speed of at least about 2,500 meters per minute will be utilized. It is generally preferred for the melt spinning procedure to be carried out at a minimum speed of about 3,500 meters per minute. In most cases the spinning speed will be within the range of about 3,500 meters per minute to about 6,500 meters per minute.

To attain the requisite degree of spinning orientation, it is generally necessary for the product of the intrinsic viscosity of the PET and the spinning speed to be at least about 2,500 (dl·m)/(g·minute). It is preferred for this product to be at least about 3,000 (dl·m)/(g·minute). It is most preferable for the product of the intrinsic viscosity and the spinning speed to be in excess of about 3,500 (dl·m)/(g·minute). As a general rule, spinning orientation increases with an increasing product of the intrinsic viscosity and spinning speed. It is normally advantageous for this product to be large to achieve a high level of birefringence and crystallinity. For instance, attaining a product of intrinsic viscosity and spinning speed as high as 6,500 (dl·m)/(g·minute) or even higher is sometimes desirable.

The design of the solidification zone is critical to the operation of the melt spinning process so that a substantially uniform quench is accomplished. It is preferable to impose quenching conditions which minimize the difference in birefringence values measured at the center and near the surface of a filament. When this difference is minimized, the radial birefringence profile is usually flattened. It is generally preferred for an inert gas atmosphere to provide the requisite cooling in the solidification zone. The inert gas atmosphere in the solidification zone will normally be at a temperature below about the glass transition temperature of the PET. It is normally preferred for the inert gas in the solidification zone to be at a temperature within the range of about 1° C. to about 60° C. below the glass transition temperature of the PET. It is most preferred for the inert gas in the solidification zone to be at a temperature within the range of about 35° C. to about 55° C. below the glass transition temperature of the PET. As a matter of convenience, the inert gas atmosphere will normally be air which is maintained at room temperature (from about 20° C. to about 30° C.). The chemical composition of the inert gas atmosphere is not critical to the operation of the melt spinning process provided that the gas is not unduly reactive with the hot PET filaments being solidified. Some representative examples of gases which can be utilized as the atmosphere include air, nitrogen, helium, argon, and the like. For purposes of cost reduction, air will normally be utilized.

Within the solidification zone, the molten PET passes from the melt to a semisolid consistency, and from the semisolid consistency to a solid consistency. While present in the solidification zone, the PET undergoes orientation which is sufficient to attain a birefringence of at least about 0.075 and a crystallinity of at least about 10%. It is desirable for the spun filaments produced to have a birefringence of greater than about 0.085 and preferred for the spun filaments to have a birefringence of at least about 0.095. It is typically more preferred for the spun filaments to have a birefringence of at least about 0.100. It is normally preferred for the spun filaments to have a crystallinity, as measured by wide-angle x-ray scattering (WAXS), of at least about 20% and more preferred for the spun filaments to have a crystallinity of at least about 25%. In a preferred embodiment of this invention, the spun filaments have a crystallinity which is within the range of about 30% to about 40%.

The solidification zone is preferably disposed below the spinnerette and the extruded PET is present while axially suspended therein for a residence time of about 0.0015 seconds to about 0.75 seconds and preferably for a residence time of about 0.065 seconds to 0.25 seconds. Commonly, the solidification zone possesses a length of about 0.25 feet (7.6 cm) to 20 feet (6 meters) and preferably a length of about 1 foot (30 cm) to about 7 feet (2 meters). The inert gas present in the solidification zone can be circulated to provide more efficient heat transfer. The quenching can be done utilizing a cross-flow or radial in-flow or out-flow technique whereby the gas is introduced along the length of the solidification zone or by any other technique capable of bringing about the desired quenching after the molten PET exits the spinnerette.

The PET spun filaments are withdrawn from the solidification zone while under a substantial stress of about 0.2 to about 0.7 cN/dtex and preferably under a stress of about 0.3 to about 0.6 cN/dtex. The stress is measured at a point immediately below the exit end of the solidification zone. For instance, the stress can be measured by placing a tension meter on the filamentary material as it exits from the solidification zone. As will be apparent to those skilled in the art, the exact stress upon the filamentary material is influenced by the molecular weight of the polyester, the temperature of the molten polyester when extruded, the size of the spinnerette openings, the polymer throughput rate during melt extrusion, the quench temperature and the rate at which the as-spun filamentary material is withdrawn from the solidification zone, as well as other factors.

After the spun filaments are prepared, they are drawn to a draw ratio of at least 1.05:1. The optimum draw ratio will vary with the spinning speed and intrinsic viscosity of the PET as well as other factors. Generally, the most favorable draw ratio decreases as the product of the intrinsic viscosity of the PET and the spinning speed increases. In cases where the product of the intrinsic viscosity of the PET and the spinning speed is within the range of 3500 to 4500 (dl·m)/(g·minute), the optimum draw ratio will normally be within the range of about 1.5:1 to about 2.0:1. The drawing procedure is carried out in a heated zone which is maintained at a temperature between the glass transition temperature of the PET and its melting point. The spun filaments are in the heated zone for a residence time of at least about 0.3 seconds. A relatively slow speed drawing procedure is typically utilized to attain the required residence time of at least about 0.3 seconds. However, the drawing speed can be increased while maintaining adequate residence time by increasing the length of the heated zone. In many cases, the spun filaments will have a residence time in the heated zone of at least about 0.5 seconds.

It is preferred to utilize a slow speed multiple-end drawing procedure in the practice of this invention. For instance, the spun filaments can be supplied from feed creels onto long godet rolls which are adequate to accommodate a large number of thread lines. The drawing procedure is then accomplished with the multiple thread lines being simultaneously drawn in the heated zone. For example, godet rolls which are approximately 1 meter in length can accommodate about 120 thread lines. By utilizing such a multiple end drawing procedure, slow speed drawing can be utilized without sacrificing throughput.

A single stage or multiple stage drawing procedure can be used to draw the spun filaments. In a representative example of a multiple stage drawing procedure, the yarns are sequentially passed through a tensioning device, a first septet, a second septet, a first heated zone, a third septet, a second heated zone and a trio to a winder. The rolls of the first septet are normally at a temperature ranging from ambient temperature (about 22° C.) to about 250° C. It is generally preferred for the first septet to be at a temperature from ambient temperature up to about 150° C. The first septet is normally operated at speeds of about 50 m/min. to about 500 m/min. The rolls of the second septet are generally at a temperature between the glass transition temperature of the PET up to about 250° C. In most cases the rolls of the second septet will be at a temperature between the glass transition temperature of the PET up to about 250° C. A draw ratio between about 1.0:1 and about 1.5:1 is normally utilized between the first septet and the second septet, with a draw ratio of about 1.0:1 being most common. The second septet is typically run at speeds of about 50 to about 600 m/min. After passing through the second septet, the yarn enters the first heated zone which is normally at a temperature of about 150° C. to about 300° C. The main draw is normally carried out in this zone at a draw ratio of about 1.2:1 to about 2.5:1. The length of the first heated zone is long enough for the yarn to achieve a minimum residence time of 0.3 second. For example, at a takeup speed of 200 m/min., the first heated zone will be at least about 1.0 m long. For a takeup speed of 400 m/min. the first heated zone will be at least about 2.0 m long and so forth. If a heated zone 5.0 m long is used in conjunction with a take up speed of 500 m/min., a residence time of 0.6 seconds is realized. In most cases the heated zone will be about 2.5 to about 10 meters in length.

After exiting the first heated zone, the yarn passes over the third septet which is run at a higher speed than the second septet to accomplish the desired draw ratio. The third septet is normally run at a speed of about 100 to about 900 m/min. and at a temperature of about 100° C. to 250° C. In many cases the third septet will be run at a speed of about 200 to about 600 m/min. The yarn then enters the second heated zone where several operations can be performed. In one embodiment, relaxation of the yarn can be accomplished by running the trio at a speed less than that of the third septet. The trio can be operated at a speed of about 1 to 10% lower than the third septet to achieve about a 1 to 10% relaxation. In a second embodiment, the trio can be operated at the same speed as the third septet in order to anneal the yarn under tension. In a third embodiment, the trio can be operated at a higher speed than the third septet to achieve further drawing of the yarn. Draw ratios of about 1.05 to 2.0 can be carried out in the second heated zone. The second heated zone is normally operated at a temperature of about 100° C. to about 300° C. The length of the second heated zone is dependent on takeup speed and should be sufficient to give at least 0.3 seconds residence time. The second heated zone is normally 2.5 to 5.0 m in length for typical takeup speeds. As mentioned, the yarn passes over the trio after exiting the second heated zone. The trio is typically operated at speeds of about 100 to about 900 m/min., depending on the length and specific operation performed in the second heated zone. The trio is usually operated at a temperature of about 10° C. to the glass transition temperature of the polyester. After leaving the trio, the drawn yarn is wound on packages for subsequent processing. Winding is normally done at about 100 to 900 m/min. In most cases the winding will be done at a speed of 200 to 600 m/min.

The drawn yarns of this invention can then be utilized in making cords. Such yarns typically are drawn to at least about 97% of the draw ratio that would fully draw the yarn. Such cords can be made by twisting together two or more drawn yarns. Most commonly, cords are made by twisting together two or three yarns. Standard techniques which are well known to persons skilled in the art can be used in twisting the drawn yarns into cords.

A plurality of cords which are made out of drawn yarns can then be woven into a greige fabric by utilizing standard weaving techniques. In cases where optimally drawn yarns are utilized, the greige woven fabric is stretched under conditions wherein further drawing is accomplished. This is generally done at an elevated temperature. For example, a temperature between 200° C. and 280° C. will commonly be utilized with a temperature of 230° C. to 250° C. being preferred. In many cases it will be convenient to provide this additional drawing while the greige fabric is being dipped. This is because the conditions commonly used in conventional dipping procedures can be easily modified so as to provide adequate tensions in order to accomplish the desired degree of additional drawing. In making high strength tire fabrics, the greige fabric can easily be stretched and relaxed in an appropriate treating dip, such as an RFL (resorcinol-formaldehyde-latex) dip. In other words, the woven fabric can be subjected to higher tensions in the RFL dip in order to provide it with further drawing which is necessary in order for the high strength fabric being made to have the requisite combination of mechanical properties. Such greige woven tire fabrics can be stretched and relaxed under tension before being dipped if so desired.

The tension required and process conditions utilized in stretching and relaxing greige fabric made utilizing optimally drawn yarns will normally be sufficient to reduce the denier of the cords in the greige woven fabric by 1% to 10% (based upon their denier prior to being stretched and relaxed in the greige woven fabric). It is generally preferred to reduce the denier of the cords by 2% to 5% during the process of stretching and relaxing the woven fabric. The tension and process conditions required to reduce denier will vary with the denier of the optimally drawn yarns utilized in making the fabric. However, persons skilled in the art will be able to ascertain the tension, temperature and other process conditions required to achieve these objectives. The optimally drawn yarns in such woven tire fabrics typically have a decitex of 1,130 to 1,180 prior to being stretched and relaxed, and accordingly, have an average decitex of from about 1,100 to 1,120 after being stretched and relaxed. Optimally drawn yarns having higher decitex prior to being stretched and relaxed can also be utilized in making woven tire fabrics containing yarns having other typical decitex values, such as 1444 or 1667, after stretching and relaxing the woven fabrics.

This invention is illustrated by the following examples which are merely for the purpose of illustration and are not to be regarded as limiting the scope of the invention or the manner in which it can be practiced. Unless specifically indicated otherwise, parts and percentages are given by weight.

EXAMPLE 1

A continuous high speed spinning process was utilized in making spun filaments. High molecular weight polyethylene terephthalate having an initial intrinsic viscosity of 1.04 was spun into 380 filaments utilizing an extruder temperature of about 290° C. A spinning speed of 4800 m/min. and a throughput of about 120 lbs./hour (54 kg/hour) were maintained. This resulted in a spun yarn having a decitex of about 1,917, an optical birefringence of about 0.105, and a crystallinity of about 33%.

The spun yarns were then subsequently drawn using a slow speed multiple-end drawing procedure. The drawing line was arranged in the following order: an 8-position creel, 2 septets (seven roll draw stands), 1 hot air oven having a working length of 2.5 meters, 1 septet, a second hot air oven having a working length of 2.5 meters, 1 trio (three roll draw stand), and a winder module. The first septet had 7 polished chrome rolls that were all heated by hot oil. The second septet also had 7 polished chrome rolls, but only the last 4 were heated. The third septet had 4 polished chrome rolls followed by 3 matte chrome rolls. Only the matte chrome rolls were heated on the third septet. All of the rolls on the trio were polished chrome with the second roll cooled by chilled water. The first septet was operated at a speed of 114 meters per minute at a temperature of 95° C. The second septet was at a speed of 115 meters per minute at a temperature of 95° C. and the third septet was operated at a speed of 200 meters per minute at a temperature of 100° C. The trio was operated at a speed of 200 meters per minute at a temperature of 15° C. The first oven was maintained at a temperature of 280° C. and the second oven was also maintained at a temperature of 280° C. A draw ratio of 1.75:1 was applied between the second and third draw stands. This draw ratio was about 97% of the draw ratio that would have fully drawn the yarn. Accordingly, the yarn was optimally drawn in accordance with U.S. Pat. No. 4,654,253 to Brown et al. No relax was used between the third septet and the trio. The resulting drawn yarn had a decitex of about 1165, a tenacity of 7.78 cN/dtex with an average free shrinkage of 6.1% as determined in a Testrite oven at 177° C. using a pretension of 0.706 cN/dtex.

The optimally drawn yarns were then twisted into a two ply tire cord having 47 turns per decimeter in the ply and 47 turns per decimeter in the cable using standard techniques. The greige tire cords made were determined to have a decitex of 2660, a tensile strength of 160 N, a LASE (load required to elongate the fabric) at 5% of 52.4 N and an elongation at break of 12.5%.

The greige tire cords were then woven into a tire fabric containing 1710 cord ends. The process utilized in weaving the tire fabric was a standard procedure. The greige tire fabric was then processed in a multistage treating dip unit. After this dipping the cords had a break strength of 151 N, a LASE at 5% of 45.4 N, an elongation at break of 15.5%, and a shrinkage of 1.8% after 2 minutes at 350° F. (177° C.) in a Testrite oven. The dipped tire fabric was then used in making two ply high performance Eagle ®VR 60 R15 radial passenger tires. The tires made exhibited reduced sidewall undulations and improved uniformity.

EXAMPLE 2

In this experiment, greige tire cords were produced utilizing the procedure specified in Example 1 except that 3 yarns were used in each cord. The spun filaments utilized in making the greige tire cords were determined to have a birefringence of 0.105 and a crystallinity of 33%. The greige tire cords made in this experiment were then dipped at 465° F. (241° C.). After this dipping, the cords had a break strength of 213 N, a LASE at 5% of 61 N, an elongation at break of 17% and a shrinkage of 1.2% after 2 minutes at 350° F. (177° C.).

EXAMPLE 3

In this experiment, greige tire cords were produced utilizing the procedure specified in Example 2 except that the spinning speed used in making the spun filaments was 4500 m/min. The spun filaments made were determined to have a birefringence of 0.105 and a crystallinity of 27%. After the greige tire cords were dipped, they were determined to have a break strength of 218 N, a LASE at 5% of 65 N, an elongation at break of 15.4%, and a shrinkage of 1.4% after 2 minutes at 350° F. (177° C.).

COMPARATIVE EXAMPLE 4

In this experiment, greige tire cords were produced utilizing the procedure specified in Example 2 except that the spinning speed used in making the spun filaments was 2500 m/min. The spun filaments made were determined to have a birefringence of 0.040 and a crystallinity of 0%. After the greige tire cords were dipped, they were determined to have a break strength of 207 N, a LASE at 5% of 61.2 N, an elongation at break of 17.2%, and a shrinkage of 2.4% after 2 minutes at 350° F. (177° C.).

COMPARATIVE EXAMPLE 5

In this experiment, spun filaments were made utilizing the procedure specified in Comparative Example 4. The spun filaments were then continuously drawn in one step utilizing a drawing speed of 5600 m/min. to a total draw of 2.3:1. After the greige tire cords were dipped, they were determined to have a shrinkage of 3.1% after 2 minutes at 350° F. (177° C.). In Comparative Example 4 wherein the spun filaments were drawn utilizing a drawing speed of 200 m/min., the greige tire cords were determined to have a shrinkage of only 2.4% after 2 minutes at 350° F. (177° C.). This experiment shows that lower shrinkage can be attained by utilizing a slow speed draw.

COMPARATIVE EXAMPLE 6

Greige tire cords were made utilizing the procedure specified in Example 2 except that the spinning speed used in making the spun filaments was 956 m/min. The spun filaments made were determined to have a birefringence of 0.0050 and a crystallinity of 0%. The greige tire cords made were then dipped and were determined to have a break strength of 198 N, a LASE at 5% of 61.4 N, an elongation at break of 16.0%, and a shrinkage of 2.7% after 2 minutes at 350° F. (177° C.).

While certain representative embodiments and details have been shown for the purpose of illustrating the present invention, it will be apparent to those skilled in this art that various changes and modifications can be made therein without departing from the scope of the invention.

What is claimed is:

1. A process for manufacturing drawn industrial yarn having high tenacity, high modulus and low shrinkage which can be made into two ply cord which exhibits a shrinkage after 2 minutes at 177° C. of less than 2%, which comprises (1) melt spinning polyethylene terephthalate into spun filaments at a spinning speed of greater than 2500 meters per minute; and (2) subsequently drawing the spun filaments at a speed which is within the range of about 100 to about 900 meters per minute in a heated zone in a separate drawing step to a draw ratio of at least about 1.05:1; wherein the draw ratio is at least about 97% of the draw ratio that would fully draw the yarn; wherein the spun filaments have a birefringence of at least about 0.075 and a crystallinity of at lest about 10%; wherein the spun filaments are in the heated zone for a residence time of at least 0.3 seconds; and wherein the yarn in the heated zone is at a temperature which is between the glass transition temperature and the melting temperature of the polyethylene terephthalate.

2. A process as specified in claim 1 wherein the melt spinning is done at a spinning speed of 3,500 m/min. to 6,500 m/min.

3. A process as specified in claim 2 wherein the polyethylene terephthalate used in spinning the filaments has an intrinsic viscosity of at least about 0.9 dl/g.

4. A process as specified in claim 3 wherein the polyethylene terephthalate being melt spun is at a temperature of about 280° C. to about 310° C.

5. A process as specified in claim 3 wherein the spun filaments ar withdrawn from a solidification zone while under a stress of about 0.2 to about 0.7 cN/dtex.

6. A process as specified in claim 2 wherein the polyethylene terephthalate has an intrinsic viscosity of at least about 1.0 dl/g.

7. A process as specified in claim 1 wherein the product of the intrinsic viscosity of the polyethylene terephthalate and the spinning speed at which the melt spinning is done is at least about 3,000 (dl·m)/(g·minutes).

8. A process as specified in claim 7 wherein the product of the intrinsic viscosity and the spinning speed is at least about 3,500 (dl·m)/(g·minute).

9. A process as specified in claim 1 wherein the spun filaments are drawn utilizing a drawing speed of about 200 m/min. to about 600 m/min.

10. A process for manufacturing drawn industrial yarn having high tenacity, high modulus and low shrinkage which can be made into two ply cord which exhibits a shrinkage after 2 minutes at 177° C. of less than 2%, which comprises drawing polyethylene terephthalate spun filaments in a heated zone at a speed which is within the range of about 100 to about 900 meters per minute to a draw ratio of at least about 1.05:1; wherein the draw ratio is at least about 97% of the draw ratio that would fully draw the yarn; wherein the spun filaments have a birefringence of at least about 0.075 and a crystallinity of at least about 10%; wherein the spun filaments were made in a separate spinning step at a spinning speed of greater than 2500 meters per minute; wherein the spun filaments are in the heated zone for a residence time of at least 0.3 seconds; and wherein the yarn in the heated zone is at a temperature which is between the glass transition temperature and the melting temperature of the polyethylene terephthalate.

11. A process as specified in claim 10 wherein a spun filaments have a birefringence of at least about 0.085 and a crystallinity of at least about 20%.

12. A process as specified in claim 10 wherein a spun filaments have a birefringence of at least about 0.095 and a crystallinity which is within the range of about 30% to about 40%.

13. A process as specified in claim 10 wherein the spun filaments are drawn utilizing a drawing speed of about 200 m/min. to about 600 m/min.

14. A process as specified in claim 13 wherein a multiple end drawing procedure is utilized.

* * * * *